US005997808A

United States Patent [19]

Jones et al.

[11] Patent Number: 5,997,808

[45] Date of Patent: Dec. 7, 1999

[54] TITANIUM ALUMINIDE ALLOYS

[75] Inventors: Ian P Jones; Tai-Tsui Cheng, both of Birmingham, United Kingdom

[73] Assignee: Rolls-Royce plc, London, United Kingdom

[21] Appl. No.: 09/109,895

[22] Filed: Jul. 2, 1998

[30] Foreign Application Priority Data

Jul. 5, 1997 [GB] United Kingdom ..... 9714391

[51] Int. Cl.[6] ..... C22C 14/00

[52] U.S. Cl. ..... 420/418; 420/552; 148/421

[58] Field of Search ..... 420/418, 552; 416/241 R, 223 R; 148/421

[56] References Cited

U.S. PATENT DOCUMENTS 4,983,357 1/1991 Mitao et al. ..... 420/418

FOREIGN PATENT DOCUMENTS 5-078769 3/1993 Japan .
6-192776 7/1994 Japan .

*Primary Examiner*—Prince Willis
*Assistant Examiner*—Andrew L. Oltmans
*Attorney, Agent, or Firm*—W. Warren Taltavull; Farkas & Manelli PLLC

[57] ABSTRACT

A titanium aluminide based alloy consisting of 42–48 at % aluminium, 2–5 at % niobium, 3–8 at % zirconium, 0–1 at % boron, 0–0.4 at % silicon and the balance, apart from incidental impurities, is titanium. The titanium aluminize alloy composition has a satisfactory combination of high tensile strength, acceptable ductility at room temperature and low secondary creep rate at elevated temperature, so as to be suitable for use in high temperature applications for example aero-engines and automobile engines. It is suitable for compressor discs and compressor blades of aero-engines.

12 Claims, No Drawings

TITANIUM ALUMINIDE ALLOYS

FIELD OF THE INVENTION

The present invention relates to titanium aluminide based alloys. In particular the present invention relates to low density titanium aluminide based alloys which can be useful for high temperature applications such as in aerospace and in automobile engines.

BACKGROUND OF THE INVENTION

Titanium aluminide alloys, particularly gamma titanium aluminide (TiAl) based alloys, possess a low density combined with high strength and are resistant to oxidation. Gamma titanium aluminide alloys offer a 200° C. temperature advantage over conventional titanium alloys for use as, for example, compressor discs and blades in aero-engines and are only about 50% of the density of nickel-based superalloys. Many aerospace and automobile engine components operate at high temperatures and so a measurement of the strength of the alloy at room temperature, although important, may not be the best indication of how a component will perform at its operating temperature. A more useful test involves loading the alloy at an elevated temperature and observing its creep rate. In particular, the secondary (steady-state) creep rate is an important guide as to how the alloy will perform at elevated temperatures. In addition, the alloy should not be too brittle at room temperature in order to reduce the possibility of fracture.

SUMMARY OF THE INVENTION

Thus it is an object of the present invention to provide an alloy composition having a satisfactory combination of high tensile strength and acceptable ductility at room temperature and low secondary creep rate at elevated temperature, so as to be suitable for use in high temperature applications.

The present invention resides in a titanium aluminide based alloy consisting of (in atomic %), 42–48 at % aluminium, 2–5 at % niobium, 3–8 at % zirconium, 0–1 at % boron, 0–0.4 at % silicon and the balance, apart from incidental impurities is titanium.

The invention also resides in an article made from the alloy defined in the immediately preceding paragraph. The article may be made, for example, by a thermomechanical process, such as forging, or by casting.

It is to be understood that oxygen is a trace impurity, unavoidably present in all titanium alloys, but it is preferably maintained below 0.15 wt %. More preferably, the oxygen content is in the range of 0.03 to 0.15 wt %.

It is desirable for an alloy to have a fine grained microstructure. This is important in limiting segregation of the alloy components. In casting applications, segregation can result in hot tearing as the metal shrinks in the mould as it solidifies. If the alloy is forged, the segregation results in microstructural inhomogeneity within the alloy. It has been found that the addition of very low levels of boron (i.e. up to 1%) refines the as-cast microstructure resulting in increased ductility and forgeability. The addition of niobium and zirconium (both beta-stabilising elements and zirconium is also gamma stabilizing) helps reduce or even eliminate the single alpha field in the phase equilibria. This allows heat treatments to be carried out over a wide range of temperature, whilst maintaining the fine-grained microstructure. This is achieved even in the absence of boron. The microstructure is further stabilised by the addition of zirconium and silicon, which results in the formation of silicide precipitates.

The alloys of the present invention also exhibit excellent processing characteristics under hot deformation conditions. For example the alloys have good forgeability.

By carefully combining the above alloying ingredients, a titanium aluminide alloy is; produced which has the desired strength, ductility and creep characteristics and a fine-grained microstructure which is retained after forging.

DETAILED DESCRIPTION OF THE INVENTION

Preferably the aluminium content of the alloy is 43–45 at %.

Preferably the niobium content of the alloy is 3–5 at % .

Preferably the zirconium content of the alloy is 3–5 at %.

Preferably the boron content of the alloy is 0.2–0.5 at %. The inclusion of boron results in titanium boride (TiB) precipitates which at higher levels may segregate into clusters. This segregation has a detrimental effect on certain processing characteristics of the alloy and may result in components with poor fatigue characteristics and short operating lives. Such segregation is minimised at lower levels of boron inclusion.

Inclusion of a minimum level of 0.3 at % boron results in further improvement of the processing characteristics of the alloy.

Preferably the silicon content of the alloy is 0.1–0.3 at %.

Most preferably said alloy consists of (in atomic %), 43–45 at % aluminium, 3–5 at % nioblum, 3–5 at % zirconium, 0.2–0.5 at % boron, 0.1–0.3 at % silicon and the balance, apart from incidental impurities, is titanium.

Embodiments of the present invention will now be described by way of example.

Examples 1 to 9 and Comparative Examples C1 C6

Samples of each alloy composition were prepared by plasma melting in a water-cooled copper hearth under argon. After melting, ingots were hot isostatic pressed (HIPped) at 1250° C., 150 MPa for 4 hours to reduce porosity, followed by isothermal forging at 1150° C. to 70% reduction in height at a strain rate of $5\times10^{-3}s^{-1}$. The forged materials were subsequently heat treated at the temperature at the temperature indicated in the Tables. The microstructures of the samples were examined and determined using optical microscopy (OM), scanning electron microscopy (SEM) and transmission electron microscopy (TEM). Each sample was tested for ultimate tensile strength (UTS), elongation, and secondary creep at 700° C. under a constant load of 200MPa. The procedure used for the room temperature tensile tests conform to European Standard BSEN10002 part 1 and the creep tests used are defined in British Standard BS3500.

Table 1 shows the results for a number of composition within the scope of the present invention. In all cases, the UTS and secondary (steady-state) creep rates are good, whilst ductility (as measured by the amount of elongation before fracture) remains within acceptable limits. A comparison of examples which differ only in the heat treatment (i.e. 1, 2 and 3, 4 and 5, 6 and 7, and, 8 and 9) demonstrate that the good creep properties are relatively in insensitive to the heat treatment.

The problem of producing an alloy having good UTS, ductility and creep rate can be seen by comparing the properties of Examples 1 to 9 with Comparative Examples C1 to C6. Commercially available alloys C1 to C3 (Table 2) exhibit satisfactory ductility (0.33 to 1.4%) and creep rates (C2) but have A poor tensile strength (302 to 445 MPa). Conversely, alloys C4 to C6 exhibit good tensile strength (662 and 819 MPa for C4 and C5 respectively) but unsatisfactory creep (49–69. $9\times10^{-10}s^{-1}$).

Key to Tables:

Microstructure: FL=Fully Lamellar; NL=Near Lamellar; DP=Duplex; T(α+β)=Transformed α+β

Heat Treatment: 1:1380° C.; 2:1350° C.; 3:1300° C.; 4:1200° C.; 5:1220° C.

UTS=Ultimate Tensile Strength

El=Elongation

TABLE 1

Properties of Alloy Compositions According to the Present Invention

| Example | Composition Ti | Al | Nb | Zr | Si | B | Micro-structure | UTS (MPa) | E1 (%) | Secondary creep rate ($\times 10^{-10}$ $s^{-1}$) |
|---|---|---|---|---|---|---|---|---|---|---|
| 1 | 47.8 | 44 | 4 | 4 | 0.2 | — | T(α + β)[2] | 696 | 0.3 | 7.1 |
| 2 | 47.8 | 44 | 4 | 4 | 0.2 | — | NL[3] | 677 | >0.5 | 8.3 |
| 3 | 47.8 | 44 | 4 | 4 | 0.2 | — | DP + β4[3] | 706 | 0.7 | 8.5 |
| 4 | 47.8 | 44 | 4 | 4 | 0.2 | 1 | DP + β[4] | 755 | 0.6 | 12.9 |
| 5 | 47.8 | 44 | 4 | 4 | 0.2 | 1 | T(α + β)[2] | 705 | 0.5 | 5.9 |
| 6 | 47 | 44 | 4 | 4 | — | 1 | DP + β[5] | 718 | 0.3 | 16.4 |
| 7 | 47 | 44 | 4 | 4 | — | 1 | T(α + β)[2] | 722 | 0.6 | 12.5 |
| 8 | 47.5 | 44 | 4 | 4 | 0.2 | 0.3 | DP + β[5] | — | — | 15.8 |
| 9 | 47.5 | 44 | 4 | 4 | 0.2 | 0.3 | T(α + β)[2] | 688 | 0.4 | 8.3 |

TABLE 2

Properties of Some Known Alloy Compositions

| Example | Composition | Micro-structure | UTS (MPa) | E1 (%) | Secondary creep rate ($\times 10^{-10}$ $s^{-1}$) |
|---|---|---|---|---|---|
| C1 | 49Ti—47Al—2Cr—Nb | FL[2] | 302 | 0.33 | — |
| C2 | 47Ti—48Al—2Cr—2Nb—1B | FL[2] | 427 | 1.0 | 13.2 |
| C3 | 47Ti—48Al—2Cr—2Nb—1B | FL[2] | 445 | 1.4 | — |

TABLE 3

Comparative Examples of Similar Alloys to those of the Present Invention

| Example | Composition Ti | Al | Nb | Zr | Si | B | Micro-structure | UTS (MPa) | E1. (%) | Secondary creep rate ($\times 10^{-10}$ $s^{-1}$) |
|---|---|---|---|---|---|---|---|---|---|---|
| C4 | 48 | 44 | 8 | — | — | — | DP[3] | 662 | 0.4 | 49 |
| C5 | 47 | 44 | 8 | — | — | 1 | DP[3] | 819 | 1.7 | 54.4 |
| C6 | 46.8 | 44 | 8 | — | 0.2 | 1 | DP[4] | — | — | 69.9 |

We claim:

1. A titanium aluminide based alloy containing 42–45 at % aluminum, 3–5 at % niobium, 3–5 at % zirconium, 0.2–0.5 at % boron, 0.1–0.3 at % silicon and the balance, apart from incidental impurities, being titanium.

2. A titanium aluminide based alloy as claimed in claim 1 wherein the alloy consists of 44 at % aluminium, 4 at % niobium, 4 at % zirconium, 0.3 at % boron, 0.2 at % silicon and the balance, apart from incidental impurities, is titanium.

3. A titanium aluminide based alloy containing 42–48 at % aluminum, 2–5 at % niobium, 3–8 at % zirconium, 0.2–0.5 at % boron, 0–0.4 at % silicon and the balance, apart from incidental impurities, being titanium.

4. A titanrum aluminide based alloy as claimed in claim 3 wherein the alloy contains at least 0.3 at % boron.

5. A titanium aluminide based alloy containing 42–48 at % aluminum, 2–5 at % niobium, 3–8 at % zirconium, 0.2–1 at % boron, 0–0.4 at % silicon and the balance, apart from incidental impurities, being titanium.

6. A titanium aluminide based alloy as claimed in claim 5 wherein the alloy contains 43–45 at % aluminium.

7. A titanium aluminide based alloy as claimed in claim 5 wherein the alloy contains 3–5 at % niobium.

8. A titanium aluminide based alloy as claimed in claim 5, wherein the alloy contains 3–5 at % zirconium.

9. A titanium aluminide based alloy as claimed in claim 5 wherein the alloy contains 0.1–0.3 at % silicon.

10. An article consisting essentially of an alloy according to claim 5.

11. An article as claimed in claim 10 wherein the article is a compressor blade.

12. An article as claimed in claim 10 wherein the article is a compressor disc.

* * * * *